United States Patent [19]

Kidwell, Jr.

[11] 4,055,481

[45] Oct. 25, 1977

[54] TWO-STAGE PROCESS FOR MANUFACTURE OF WHITE OILS

[75] Inventor: Louis E. Kidwell, Jr., Shreveport, La.

[73] Assignee: Pennzoil Company, Shreveport, La.

[21] Appl. No.: 707,949

[22] Filed: July 23, 1976

[51] Int. Cl.[2] ..... C10G 23/02

[52] U.S. Cl. ..... 208/89

[58] Field of Search ..... 208/89, 57, 210, 144, 208/143

[56] References Cited

U.S. PATENT DOCUMENTS

| | | | |
|---|---|---|---|
| 3,392,112 | 7/1968 | Bercik et al. | 208/210 |
| 3,915,841 | 10/1975 | Murphy, Jr. et al. | 208/143 |
| Re. 27,845 | 12/1973 | Gilbert et al. | 208/89 |

*Primary Examiner*—George Crasanakis

*Attorney, Agent, or Firm*—Lowe, King, Price & Markva

[57] ABSTRACT

Production of White Oils of sufficient purity to pass the Hot Acid Carbonizable Substances Test and Ultraviolet Absorbance Test is carried out in two stages utilizing lubricating oil feedstock of a broad range of viscosities. The first stage hydrogenation utilizes a sulfur-resistant catalyst which produces an intermediate product of lower viscosity than the starting feedstock. The second stage hydrogenation catalyst is nickel on alumina and is further characterized as having a BET surface area in the range of 130–190 $m^2/g$.

10 Claims, No Drawings

TWO-STAGE PROCESS FOR MANUFACTURE OF WHITE OILS su

BACKGROUND OF THE INVENTION

1. FIELD OF THE INVENTION

This invention relates to a method for the production of highly refined oils called white oils from petroleum products, and more particularly to a novel two step process to produce white oils of pharmaceutical grade which will pass the Hot Acid Carbonizable Substances Test and Ultraviolet Absorbance Test.

2. DESCRIPTION OF THE PRIOR ART

White mineral oils called white oils are colorless, transparent, oily liquids obtained by the refining of crude petroleum feedstocks. In the production of white oils the petroleum feedstocks are refined to eliminate as completely as possible oxygen, nitrogen, and sulfur compounds, reactive hydrocarbons including aromatics, and any other impurity which would prevent use of the resulting white oil in the pharmaceutical industry. White oils generally fall into two classes, that is, technical grade white oils which are used in cosmetics, textile lubrication, bases for insecticides and the like, and more highly refined pharmaceutical grade white oils such as used in drug compositions, foods and for the lubrication of food handling machinery. For such applications, the pharmaceutical grade white oils must be chemically inert and without color, odor or taste. The present invention is primarily concerned with the production of pharmaceutical grade white oils.

The prior art is well aware of numerous processes for the production of white oils of both grades. In general, the first step in the production of white oil has been the removal of the lighter portions, such as gasoline, naphtha, kerosene, and light fractions, from the feedstock by fractional distillation. In the early processes the white oil was then refined by treatment with sulfuric acid to remove unsaturated aromatic and unstable hydroaromatic compounds which comprised most of the impurities present in the oil. Usually, the acid treated oil was then subject to adsorption refining to remove such impurities as carbon, coke, asphaltic substances, coloring matter and the like.

The conventional methods of making white oils with sulfuric acid however, have been subject to objection in recent years since acid treating is costly and gives rise to unmanageable amounts of sludge comprising sulfuric acid aromatic adducts and thus environmental objections arise because of the attendant disposal and corrosion problems.

Because of objections to sulfuric acid treatments, new procedures have been developed for the production of white oils from hydrocarbond feedstocks. Representative processes are described, for example, in U.S. Pat. Nos. 3,629,096, 3,553,107, 3,673,078, U.S. Pat. No. R. 27,845, U.S. Pat. Nos. 3,080,313 and 3,392,112. In general, all of these patents disclose production of white oils in generally highly refined states by subjecting the feedstocks to contact with various types of catalysts in one or more steps. In general, in the first step of these processes the feedstock is subjected to a hydrogenation treatment in the presence of a sulfur resistant catalyst to produce an intermediate product of reasonably low sulfur content. The intermediate product is then subjected to a second stage treatment in the presence of hydrogen and a sulfur sensitive catalyst in order to reduce aromatic compounds and produce a substantially pure product. In many of the prior art patents a third stage is then utilized by contacting the second stage product with sulfuric acid and/or adsorption in order to complete the purification and provide a white oil of sufficient purity to meet the pharmaceutical standards for food grade white oils.

Of particular pertinence to the present invention is U.S. Pat. No. 3,392,112 to Bercik et al which discloses a method for manufacturing refined oils by a two stage process involving an initial stage of contacting a petroleum hydrocarbon feedback with a sulfur resistant hydrogenation catalyst under hydrogenation conditions to produce a partly hydrogenated intermediate product. Thereafter, the intermediate product is then contacted in a second hydrogenation stage with a sulfur-resistant catalyst comprising reduced nickel composited with a diatomaceous earth. According to the patent, this two stage system will provide a product having a very low sulfur content and having sufficient purity to pass the tests required by the pharmaceutical industry.

The process of the present invention is an improvement on this prior process in that the catalyst used in the second stage of the process can be supported not only on Keiselguhr but also on alumina and thus the process is not subject to the specific requirements for using a diatomaceous earth catalyst support. Moreover, the process of the present invention can also be used on feedstocks having a wide range of viscosities to produce very highly refined white oils. Thus, the present invention provides a process of wide application in the art to provide a pharmaceutical grade white oil in a two stage treatment.

SUMMARY OF THE INVENTION

It is accordingly one object of this invention to provide a process for the production of pharmaceutical grade white oils.

It is a further object to this invention to provide a two stage catalytic treatment of petroleum hydrocarbon feedstocks to produce highly pure pharmaceutical grade white oils.

A still further object of the invention is to provide a two stage treatment of hydrocarbon feedstocks to produce refind white oils having sufficient purity to pass the Hot Acid Carbonizable Substances Test and Ultraviolet Absorbance Test without the necessity for further purification steps.

A still further object of the invention is to provide a two step catalytic treatment of hydrocarbon feedstocks for the production of highly pure white oils for use in pharmaceutical applications utilizing a nickel catalyst in the second stage and without the necessity of additional treatment steps wherein the hydrocarbon feedstock used may have a wide range of viscosities.

Other objects and advantages of the present invention will become apparent as the description thereof proceeds.

In satisfaction of the foregoing objects and advantages there is provided by this invention a method for the manufacture of highly refined pharmaceutical grade white oils by a two stage catalytic treatment which comprises subjecting a petroleum feedstock to a first stage hydrogenation in the presence of a sulfur resistant catalyst to effect desulfurization, and then contacting the product recovered from the first stage to a second stage hydrogenation treatment in the presence of a nickel catalyst on a support. The white oil product covered from the second stage is sufficiently pure to pass the Hot Acid Carbonizable Substances Test and Ultraviolet Absorbance Test without the necessity of additional treatment.

DESCRIPTION OF PREFERRED EMBODIMENTS

The present invention is concerned with a two stage catalytic treatment of hydrocarbon feedstocks for the production of pharmaceutical grade white oils which do not require further treatment in order to meet the standards established by the pharmaceutical industry for white mineral oils of food grade purity. While the process of the present invention is primarily concerned with a two stage catalytic hydrogenation process for the preparation of pharmaceutical grade white oils, it is also applicable to the production of other related petroleum products such as technical grade white oil, petrolatums, paraffin waxes, petroleum jelly, charcoal lighter fluid and the like.

White oil specifications are rather difficult to meet as such oils must be colorless, must pass the Ultraviolet Absorbance Test (ASTM D-2269), and the USP Hot Acid Test (ASTM D-565). As defined by the U.S. Pharmacopeia XVIII, at page 436, white oils are mineral oils defined as a mixture of liquid hydrocarbons obtained from petroleum which are colorless, transparent, oily liquids free or nearly free from fluorescence, are odorless and tasteless when cold, and develop not more than a faint odor of petroleum when heated. The mineral or white oil must be of such purity as to pass the Ultraviolet Absorbance Test for petroleum products identified as ASTM D-2269. The Ultraviolet Absorbance Test identified as ASTM D-2269 is a method for measuring the ultraviolet absorption of a variety of petroleum products and generally measures the ultraviolet absorbance of an extract in the range of 260–350 nm, which absorbance is then compared with that of a of a naphthalene standard. This test sets forth limits for the presence of polynuclear compound impurities in the white oil.

The Hot Acid Carbonizable Substances Test is described as ASTM D-565 and a product is reported as passing the test only when the oil layer shows no change in color and the acid level is not darker than that of the reference standard colorimetric solution. A white oil must pass this test in order to conform to the standard of quality required for pharmaceutical use. From this test it will be seen that for purposes of interpreting test results, the art has recognized that a value of 16.0 or below on the Hellige Amber C Color Wheel is sufficient to pass the carbonizable substances test.

In the process of the present invention the initial feedstock comprises any petroleum hydrocarbon fraction capable of yielding a product of the desired purity range by treatment in accordance with the process steps of the present invention. When the desired final product of the present invention is a white mineral oil or other oil in the lubricating range of viscosities, the charge to the first stage is perferably a light or medium lubricating distillate which generally has viscosities ranging from about 60 SUS to 600 SUS at 37.8° C. For pharmaceutical grade white oil production, the charge stock is preferably a raffinate resulting from solvent treatment of a light or medium neutral distillate oil with a selective solvent, i.e., a distillate fraction which has been extracted. For the production of technical grade white oils, a non-solvent extracted distillate oil may be used as the starting material. When the final product is charcoal lighter fluid, the charge stock can comprise alkylate bottoms such as materials obtained from sulfuric acid or hydrogen fluoride alkylation processes boiling above the gasoline range. When the final product is petrolatum the charge stock can be paraffin slack wax, microcrystalline waxes, oils and the like. For producing pharmaceutical waxes, paraffin wax obtained by solvent dewaxing of a waxy lubrication distillate is suitable.

In the most preferred embodiment of the present invention however, the charge stock is a solvent extracted light or medium lubricating distillate which has a viscosity ranging from about 60 SUS to about 600 SUS viscosity when measured at 37.8° C. It should be noted in this regard that it is a feature of the present invention that white mineral oils of food grade are obtained when using high viscosity feedstocks, that is feedstocks which have viscosities of 100, 350 and 500 SUS at 37.8° C. and higher.

In the initial step of the present invention the feedstock is subjected to hydrogenation in the presence of a sulfur-resistant catalyst for the purpose of achieving desulfurization, some aromatic reduction and, in some cases, cracking to facilitate hydrogenation in the second stage. In general, catalysts which may be used in the first step include the sulfur resistant metals of Group VIB of the Periodic System and the metals of Group VIII of the Periodic System as well as their oxides, sulfides and mixtures thereof that possess hydrogenation activity. Examples of preferred first stage catalysts are nickel tungsten sulfides, tungsten sulfide, nickel sulfide, nickel oxide, molybdenum sulfide, cobalt molybdate, nickel molybdate and mixtures thereof. The most preferred catalysts are nickel molybdenum sulfide, cobalt molybdenum sulfide or nickel tungsten sulfide. The catalyst may be employed in unsupported form or can be composited with porous carriers of high surface alumina composites, synthetic magnesia composites, activated clays and the like. Highly preferred commercially available catalysts which can be used in the first stage are nickel oxide and tungsten oxide which have been treated with a sulfide before use to convert the components to nickel sulfide and tungsten sulfide, on a support such as alumina or silica alumina. The preparation of such supported catalyst compositions may be achieved by impregnating the carrier material with a solution containing soluble compounds of the Group VI-B metal or metals, such as ammonium meta tungstate, and/or soluble compounds of the Group VIII metal or metals such as nickel nitrate. After the desired proportions of such soluble compounds have been placed in the impregnating solution, the impregnated carrier is dried and calcined. In order to improve the activity of the catalyst it is preferred to sulfide the same prior to use by treatment with a suitable sulfiding agent such as hydrogen sulfide, carbon disulfide, ethyl mercaptan, methyl sulfide, propyl sulfide, ammonium sulfide, or the like. The product of the sulfiding step is a mixture of sulfides, oxides, free sulfur and free metal. The sulfiding operation is usually conducted at a temperature of 500° to 700°F. for a period of from about 2 to 20 hours. In the preferred use of multiple catalyst impregnation techniques, the proportions of the soluble compounds placed in solution are adjusted to provide the desired amount of metal and the desired atomic ratio of metals on the carrier support. The preferred atomic ratios of Group VIII metals and Group VI-B metals in either the supported or unsupported form should be in a range from about 9:1 and 1:3.

The first stage of the process is operated under generally known hydrogenation conditions at temperatures in the range of about 300° to 400° C. and pressures ranging from about 800 to 4,000 psig. In general, as to temperatures and pressures, it may be said that the preferred pressure range is 1100–3500 psig and that the preferred temperature range is from about 325° to about 385° C.

The first stage of the reaction is preferably carried out at space velocities ranging from about 0.1 to 2.0 LHSV and with a ratio of hydrogen to oil charge of about 3,000 to 5,000 standard cubic feet of pure hydrogen per barrel of oil. When it is preferred that some cracking of carbon/carbon bonds accompany desulfurization and hydrogenation, it is preferable to employ temperatures in the upper portion of the indicated range, for example near 340°–400° C. together with space velocities in the lower portion of the range. Conversely, when little cracking is desired, less severe conditions of temperature and space velocities should be used. It is highly preferable to conduct the first stage hydrogenation so that the sulfur content will be rendered as much as possible and so that as much as possible of the aromatics are hydrogenated. Thus both cracking (i.e. dealkylation, etc.) and hydrogenation are occurring in the first stage.

The product recovered from the first hydrogenation stage, referred to herein as first stage effluent, is generally a water white liquid which will preferably be a composition in which the aromatics and sulfur present have been substantially reduced. In general, it may be stated that the presence of aromatics in the composition will have been reduced from about 13 weight percent down to about 4 to 8 weight percent because of the hydrogenation and cracking, (i.e. dealkylation) occurring during the first step of the reaction. The sulfur present in the original charge stock will be found to have dropped to less than about 10 ppm or in the range of 0 to 10 ppm. In plant run size practice, it is preferrable to reduce the sulfur content down to less than 1 ppm for best results to prevent catalyst poisoning in the second stage.

The effluent obtained from the first stage reaction is preferably degassed to remove any hydrogen sulfide present prior to passing to the second stage hydrogenation. A topping operation or solvent dewaxing treatment for further refining prior to introduction to the second stage is not necessary but is not excluded from the concept of the present invention.

Further, all or a portion of the raw feedstock or intermediate product can be mixed with one or more diluent oils obtained from an external source prior to introduction into the first or second stage of the process. However, the external source product should be substantially the same purity and have similar characteristics as the intermediate product. However, to achieve the beneficial effects of dilution, the diluent should have a lower viscosity than the intermediate product. Dilution is particularly worthwhile for example in decreasing the severity of conditions required to obtain a desired product.

The product resulting from the first step reaction will be found to show a significant viscosity break from the startng charge. Usually the higher the starting viscosity, the more substantial will be the viscosity break. In general, the viscosity break for the higher viscosity products will range from about 75 to 280 and for the lower viscosity materials may range from about 9 to 40.

The first stage effluent is passed to a second stage hydrogenation catalyst step which is a particularly significant feature of the present invention. In the second stage, the nature of the catalyst used is extremely important to the successful two stage system of the present invention. In the second stage the catalyst is a nickel catalyst on alumina support with suitable supports being gamma or alpha alumina. Gamma alumina is preferred. The catalyst of the second stage is to be distinquished from Raney nickel and the reduced nickel on Keiselguhr disclosed as a second stage catalyst in U.S. Pat. No. 3,392,112.

The second stage nickel catalyst is prepared by impregnation of the desired carrier with a water solution of one or more soluble salts of the nickel metal, drying and calcining in known manner. A commercially available catalyst suitable as the second stage catalyst is 60% nickel on gamma alumina sold under the designation 230T, available from the Calsicat Division of Mallinckrodt Chemical Company.

The second stage nickel catalysts of the present invention generally have BET surface areas in the range of 130m$^2$/g to about 190m$^2$/g, and bulk densities in the range of about 50 to 90 lb/ft$^3$. Of the preferred catalysts, the 60% nickel on alumina catalyst has a BET surface area of 150m$^2$/g and a bulk density of 63 lb/ft$^3$.

It has been found according to the present invention that the use of the nickel catalyst of this invention in the second stage of the present process, when combined with the conditions of the second stage as desired, results in a white oil which will pass the Hot Acid Carbonizable Substances Test, the Ultraviolet Absorbance Test and all other tests prescribed by the U.S. Pharmacopeia without the necessity for additional treatment such as with sulfuric acid or adsorption with bauxite.

The second hydrogenation stage is conducted at a temperature in the range of about 225°–300° C. and a pressure ranging from about 2,000–4,000 psig. The space velocity is preferably about 0.1 up to about 2.0 with a hydrogen recycle rate of about 3,500 to 8,000 SCF/Barrel.

In practicing the process, it is highly desirable to utilize a guard tube for treatment of the first stage effluent prior to introduction into the second stage nickel hydrogenation. The guard tube has been found useful to prevent a buildup of sulfur in the system and to reduce the possibility of sulfur poisoning of the nickel catalyst in the second stage. However, the guard tube is not a critical aspect of the invention and is not generally required for good results. In conducting a continuous process with gas phase recycle, a guard tube can also be used in front of the recycle gas phase as added protection against sulfur poisoning. Guard tubes of this type are well known in the art and are used in the conventional manner.

The products resulting from the second stage hydrogenation are characterized by an extremely low sulfur content of less than about 1 ppm and are colorless, odorless, liquids which pass the Hot Acid Carbonizable Substances Test with a value of less than 16 and also pass the Ultraviolet Absorbance Test. There is no significant viscosity break in the final product from the first stage effluent.

While the products resulting from the two stage hydrogenation process of the present invention are of sufficient purity to pass the Hot Acid Carbonizable Substances Test and Ultraviolet Absorbance Test without further purification, the products may also be further purified by a sulfuric acid treatment or bauxite absorption by methods well known in the art. These additional treatments may be used where ultra-refined products are desired for special applications. Accordingly, the invention is also inclusive of these additional steps.

The following examples are presented to illustrate the invention but it is not considered to be limited thereto. In these examples and throughout the specification, parts are by weight unless otherwise indicated.

EXAMPLE 1

In this Example, the starting feedstock was a solvent extracted lubricating oil hydrocarbon fraction having a viscosity of approximately 506 SUS at 37.8° C. In the first stage of the reaction this feedback was subjected to hydrogenation at a temperature of 350° C. at a space velocity of 1.0 LHSV, a pressure of 3,000 psig at a recycle rate of 4,400 SCF/barrel. The catalyst for the first stage hydrogenation was a nickel tungsten sulfide catalyst formed by sulfiding nickel oxide and tungsten oxide with hydrogen sulfide prior to use to convert the components to nickel sulfide and tungsten sulfide, the catalyst being contained on alumina support. Processes for preparation of catalysts of this type are described hereinbefore. The effluent resulting from this first stage hydrogenation was a water white liquid having a viscosity of 313 SUS at 37.8°C.

This first stage product was then subjected to a second stage hydrogenation by contact with hydrogen in the presence of a catalyst comprising 60% nickel deposited on alumina, this catalyst being commercially available under the designation 230 T from the Calsicat Division of Malinckrodt Chemical Co. The conditions for the second stage hydrogenation were a temperature of 245° C., a pressure of 2,500 psig, at a space velocity of .23 LHSV and a recycle rate of 5,550 SCF/barrel.

Examination of the product resulting from the second stage hydrogenation indicated that the product was a water white, high purity white oil having a viscosity of 302 SUS at 37.8° C. which product passed the Hot Acid Carbonizable Substances Test with a hot acid number of 11.0.

EXAMPLE II

In this example, the charge stock was the same as Example I, that is, a solvent extracted lubrication oil hydrocarbon fraction having a viscosity of about 506 SUS at 37.8° C. Also, the catalysts maintained in the first and second stage were the same as described for Example I. However, the conditions for conducting the hydrogenations were more severe than those of Example I. Thus, in the first stage hydrogenation of this example, the temperature was 360° C. at a space velocity of 1.0 LHSV, a pressure of 3,000 psig and a recycle rate of 4,500 SCF/ barrel. The resulting intermediate product showed a more significant viscosity break between the starting charge and the final product, the viscosity of the intermediate product being 227 SUS at 37.8° C.

In the second stage reaction the same catalyst was utilized as in Example I but the conditions comprised a temperature of 284°C., a space velocity of .22 LHSV, a pressure of 2500 psig and a recycle rate of 7070 SCF/barrel.

The product resulting from the second stage hydrogenation showed a viscosity of 206 SUS at 37.8° C., a hot acid number of 11.4 and an ultraviolet absorbance value of 0.052. Thus, the second stage product also passed the Hot Acid Carbonizable Substance Test and the Ultraviolet Absorbance Test.

EXAMPLE III

In this example the starting charge feedstock was the same as in Example I and the first stage catalyst was the catalyst described in Example I. However, in this example the first stage reaction conditions comprised a temperature of 350° C., a pressure 3,000 psig, at a space velocity of 1.0 LHSV, and a recycle rate of 4,630 SCF/barrel. The intermediate product resulting from the first stage hydrogenation showed a viscosity of 313 SUS at 37.8° C.

In the second stage of hydrogenation of this example, the catalyst was a 60% nickel on alumina catalyst which is a catalyst commercially available from the Calsicat Division of Malinckrodt Chemical Co. The conditions for the second stage comrised a temperature of 245° C., a pressure of 2500 psig, aspace velocity of 0.23 LHSV and a recycle rate of 5600 SCF/barrel.

The resulting white oil product was a clear, odorless liquid which showed a viscosity of 302 SUS at 37.8° C., a hot acid number of 11.4 and an ultraviolet absorption value of 0.03. Thus, the product resulting from this example also passed the Hot Acid Carbonizable Substances Test and the Ultraviolet Absorbance Test.

EXAMPLE IV

In this example the charge stock was the same as in Example I and the catalysts utilized in the first and second stages were the same as in Example III. However, the conditions were more severe in this example than in Example III. In this example the conditions for the first stage hydrogenation comprised a temperature of 360° C., a pressure of 3,000 psig at a space velocity of 1.0 LHSV, and a recycle rate of 4,500 SCF/barrel. The intermediate water white oil product resulting from the first stage hydrogenation showed a viscosity of 277 SUS at 37.8° C.

In the second stage hydrogenation the intermediate product from the first stage was subjected to hydrogenation over the catalyst described in Example III at a temperature of 245° C., a pressure of 2500 psig at a space velocity of 0.22 LHSV, and recycle rate of 7300 SCF/barrel.

The clear white oil product resulting from the second stage showed a viscosity of 221 SUS at 37.8° C. with a hot acid number of 10.3. Thus, this product also passed the Hot Acid Carbonizable Substances Test.

EXAMPLE V

In this example the starting charge stock was a solvent extracted lubricating oil having a viscosity of 360 SUS at 37.8° C. The catalyst used in the first stage hydrogenation was a sulfided Ni-Mo catalyst available commercially from American Cyanamid under the designation HDS-9A. The first stage hydrogenation was conducted at a temperature of 365° C., a pressure of 1,500 psig, at a space velocity of 1.0 LHSV, and a recycle rate of 3700 SCF/barrel. The product resulting from this step was a water white liquid showng a viscosity of 195 SUS at 37.8° C.

In the second stage of this example, the intermediate product was subjected to the second stage hydrogenation in the presence of the 230 T nickel on Alumina catalyst as described in Example I. In this second stage, the hydrogenation was conducted at a temperature of 246° C., a pressure of 3,000 psig, a space velocity of 0.20 LHSV and a recycle rate of 5,920 SCF/barrel.

The product resulting from the second stage hydrogenation was a clear, odorless, white oil having a viscosity of 196 SUS at 37.8° C., a hot acid number of 10.0 and an ultraviolet absorbance of 0.027, thus being a highly pure product that passed both the Hot Acid Carbonizable Substances Test and the Ultraviolet Absorbance Test.

EXAMPLE VI

In this example the starting feedstock was the same 360 SUS viscosity material as used in Example V. Also, the first stage catalyst was the nickel-tungsten sulfide catalyst described in Example I and the second stage nickel hydrogenation catalyst was the catalyst described in Example I. However, the hydrogenation conditions in this example were more severe than those of Example V. In the first stage hydrogenation, the temperature was 360° C., the pressure was 3,000 psig, the space velocity was 1.0 LHSV, and the recycle rate of 4,120 SCF/barrel.

The intermediate product resulting from this first stage hydrogenation was a water white liquid having a viscosity of 156 SUS at 37.8° C.

In the second stage hydrogenation over the 230 T catalyst described in Example I, the temperature was 265° C. at a pressure of 3,000 psig, a space velocity of 0.23 LHSV, and a recycle rate of 6,260 SCF/barrel.

The product resulting from this second stage hydrogenation showed a viscosity of 162 SUS at 37.8° C. and passed the Hot Acid Carbonizable Substances Test with a hot acid number of 11.0 and also passed the Ultraviolet Absorbance Test with a UV value of 0.08.

EXAMPLE VII

In this example the starting material was a low viscosity solvent extracted lubricating oil hydrocarbon fraction having a viscosity of 105 SUS at 37.8° C. The catalyst in the first stage hydrogenation was the Ni-W catalyst described in Example I. The first stage hydrogenation was conducted at a temperature of 370° C., a pressure of 3,000 psig, a space velocity of 1.5 LHSV, and a recycle rate of 3,920 SCF/barrel. Vis 64.8

In the second stage, the first stage effluent was hydrogenated over the 230 T catalyst comprising nickel on alumina described in Example I. The hydrogenation conditions comprised a hydrogenation temperature of 270° C., a pressure of 3,000 psig, a space velocity of 0.50 LHSV, and a recycle rate of 3,930 SCF/barrel.

The resulting clear, odorless, white oil product had a viscosity of 67.9 SUS at 37.8° C., and passed the Hot Acid Carbonizable Substances Test with a hot acid number of 13.0 and passed the Ultraviolet Absorbance Test with a UV value of 0.03.

EXAMPLE VIII

In this example the same starting hydrocarbon feed was used as in Example VII, that is, a solvent extracted lubricating oil fraction having a viscosity of 105 SUS at 37.8° C. The first stage hydrogenation was conducted in the presence of the Ni-W catalyst described in Example I under conditions comprising a temperature of 330° C., a pressure of 3,000 psig, at a space velocity of 0.97 LHSV, and a recycle rate of 4,610 SCF/barrel. The water white liquid product resulting from this hydrogenation stage showed a viscosity of 82.4 SUS at 37.8° C.

In the second stage of this example, the intermediate product was subjcted to hydrogenation in the presence of the 230 T Ni on Alumina catalyst described in Example I under conditions comprising a temperature of 265° C., a space velocity of 0.23, a pressure of 3,000 psig and a recycle rate of 6,240 SCF/barrel.

The resulting clear, odorless, white oil product from this example showed a viscosity of 88.3 and this product passed the Hot Acid Carbonizable Substances Test with a hot acid number of 13.0 and passed the Ultraviolet Absorbance Test with a UV value of 0.01.

The invention has been described herein with reference to certain preferred embodiments. However, as obvious variations thereon will become apparent to those skilled in the art the invention is not to be considered as limited thereto.

What is claimed is:

1. A method for the production of pharmaceutical grade white oils having sufficient purity to pass the Hot Acid Carbonizable Substances Test and the Ultraviolet Absorbance Test, which comprises the steps of subjecting a lubricating oil feedstock having a viscosity ranging from about 60 to about 600 SUS at 37.8° C., to a first stage hydrogenation in the presence of a first stage sulfur-resistant catalyst having a metal, metal oxide or metal sulfide from Group VI-B and a metal, metal oxide or metal sulfide from Group VIII of the Periodic System of the Elements, at a temperature in the range of about 300° to about 400° C. and a pressure of from 800–4,000 psig, to produce a first stage intermediate product having a viscosity reduced from the viscosity of the starting feedstock, and then subjecting the first stage intermediate product to a second stage hydrogenation in the presence of a second stage hydrogenation catalyst consisting essentially of nickel on alumina, said catalyst having a BET surface area in the range of 130 $m^2/g$ to 190 $m^2/g$, at a temperature ranging from 225° to 300° C., and a pressure ranging from 2,000–4,000 psig, to produce a colorless, odorless, white oil having a hot acid number of less than 16 on the Hellige Amber C Color Wheel and an ultraviolet absorbance value of less than 0.1.

2. A method according to claim 1 wherein the lubricating oil feedstock is a solvent extracted lubricating oil having a viscosity range from 70 SUS at 37.8° C. to 500 SUS at 37.8° C.

3. A method according to claim 1 wherein said first stage catalyst is selected from the group consisting of cobalt molybdenum sulfide, nickel molybdenum sulfide and nickel tungsten sulfide.

4. A method according to claim 1 wherein said first stage catalyst is contained on a porous carrier selected from the group consisting of alumina, silica gels, synthetic silica, alumina composites, synthetic silica magnesia composites, activated clays, and mixtures thereof.

5. A method according to claim 1 wherein the space velocity for the first stage hydrogenation ranges from about 0.1 to 2.0 LHSV.

6. A method according to claim 1 said second stage is 60% nickel deposited on gamma alumina.

7. A method according to claim 1 wherein the space velocity in the second hydrogenation stage ranges from about 0.1 to about 2.0.

8. A method according to claim 1 wherein the feedstock has a viscosity of about 100 SUS at 37.8° C.

9. A method according to claim 1 wherein the feedstock has a viscosity of about 350 SUS at 37.8° C.

10. A method according to claim 1 wherein the feedstock has a viscosity of about 500 SUS at 37.8° C.

* * * * *

UNITED STATES PATENT AND TRADEMARK OFFICE

CERTIFICATE OF CORRECTION

PATENT NO. : 4,055,481

DATED : October 25, 1977

INVENTOR(S) : LOUIS E. KIDWELL, JR.

It is certified that error appears in the above-identified patent and that said Letters Patent are hereby corrected as shown below:

Column 1, line 43, delete "subject" and insert --subjected--;
line 55, delete "hydrocarbond" and insert --hydrocarbon--.

Column 2, line 12, delete "feedback" and insert --feedstock--;
line 39, delete "to" and insert --of--;
line 45, delete "refind" and insert --refined--.

Column 3, line 1, delete "covered" and insert --recovered--;
line 38, delete "of a of a" and insert --of a--.

Column 5, line 23, delete "rendered" and insert --reduced--;
line 41, delete "preferrable" and insert --preferable--;
line 64, delete "step" and insert --stage--.

Column 6, line 11, delete "distinquished" and insert --distinguished--;
line 17, before "soluble" insert --water--;
line 32, delete "desired" and insert --described--;
line 43, delete "Barrel" and insert --barrel--.

Column 7, line 4, delete "absorption" and insert --adsorption--;
line 18, delete "feedback" and insert --feedstock--;
line 36, delete "Malinckrodt" and insert --Mallinckrodt--.

UNITED STATES PATENT OFFICE

CERTIFICATE OF CORRECTION

PATENT NO. 4,055,481

DATED October 25, 1977

INVENTOR(S) LOUIS E. KIDWELL, JR.

It is certified that error appears in the above-identified patent and that said Letters Patent are hereby corrected as shown below:

Column 8, line 3, delete "Substance" and insert --Substances--;
line 11, after "pressure" insert --of--;
line 19, delete "Malinckrodt" and insert --Mallinckrodt--;
line 20, delete "comrised" and insert --comprised--;
line 21, delete "aspace" and insert --a space--;
line 45, delete "245° C." and insert --254° C.--.

Column 9, line 23, delete "of" and insert --was--.

Column 10, line 2, delete "subjcted" and insert --subjected--;
line 57 (claim 6, line 1), after "stage", insert --catalyst--;
line 61 (claim 7, line 3), after "2.0" insert --LHSV--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*